United States Patent [19]

Borgato

[11] 4,434,635

[45] Mar. 6, 1984

[54] MANUALLY AND ELECTRICALLY COMMANDED AUTOMATIC HOOKLOCK

[75] Inventor: Augusto Borgato, Rovigo, Italy

[73] Assignee: F.A.M.A. di Sandra Borgato & C., S.n.c., Italy

[21] Appl. No.: 242,507

[22] Filed: Mar. 10, 1981

[30] Foreign Application Priority Data

Mar. 11, 1980 [IT] Italy ..... 64503 A/80
May 7, 1980 [IT] Italy ..... 64504 A/80

[51] Int. Cl.[3] ..... E05B 47/00

[52] U.S. Cl. ..... 70/279; 70/84; 70/95; 292/108; 292/201

[58] Field of Search ..... 70/279, 282, 95, 84; 292/108, 201

[56] References Cited

U.S. PATENT DOCUMENTS

| | | | |
|---|---|---|---|
| 2,045,186 | 6/1936 | Hensel | 70/279 |
| 2,943,880 | 7/1960 | Joachim | 70/279 |
| 3,142,166 | 7/1964 | Adam | 70/279 |
| 3,504,511 | 4/1970 | Allen | 70/241 |
| 3,831,408 | 8/1974 | Feathermann | 70/84 |
| 4,170,374 | 10/1979 | Garcia | 292/201 |
| 4,268,076 | 5/1981 | Itoi | 70/279 |

FOREIGN PATENT DOCUMENTS

| | | |
|---|---|---|
| 1982300 | 3/1968 | Fed. Rep. of Germany . |
| 2014230 | 8/1979 | United Kingdom . |

*Primary Examiner*—Robert L. Wolfe
*Attorney, Agent, or Firm*—Beveridge, DeGrandi & Kline

[57] ABSTRACT

An automatic hook lock which is electrically and manually operable and is particularly adapted for manual, motorized or remotely controlled sliding gates to which it is attached on the surface thereof or within the interior thereof. The lock consists of a rectangular metal box containing an electromagnetic solenoid with relative magnetic plate, a cylinder lock with a key, a hook and a system of five rocker levers actuated by a spring-compressed plunger. The lock is assembled in such a way that every time the solenoid receives an electrical impulse, the magnetic plate is moved to release the system of rocker levers. The combined action automatically provides the freeing and elevation of the hook. The inverse, blocking action occurs automatically with the closing of the gate. The mechanical, manual opening of the lock is achieved using a key.

4 Claims, 3 Drawing Figures

MANUALLY AND ELECTRICALLY COMMANDED AUTOMATIC HOOKLOCK

BACKGROUND OF THE INVENTION

This invention relates to an automatic hook lock that can be operated either electrically or mechanically, and is particularly applicable to sliding gates. The shutting and opening of an entrance or passage can be achieved by use of sliding gates which might be operated either manually or by specific mechanical systems. In each of these cases, when the gate reaches the gate post it is necessary to provide for a means of fastening the same. In the case of manually actuated sliding gates, this is achieved by providing the gate with a hook lock mechanism to be operated by a key. The necessity for operation of the lock every time the gate has to be opened or shut renders the manual operation impractical and, indeed, impossible with gates operated by remote control. Actually, the application of locks on remote controlled sliding gates and, in particular, on those which are motorized, is achieved by the use of electrical equipment fixed on the gate post in correspondence with the locking mechanism. To function, the hook must necessarily be moved completely free, leaving the engagement and the successive disengagement of the same to the electrical equipment. The use of this type of hook does not, on the other hand, give the necessary security, as the hook can be easily operated by the introduction of a metal foil between the gate and the gate post. In conclusion, we assert that the adoption of a mechanical lock and separate electrical equipment does not give the required security and is more expensive, because it requires the use of two mechanisms.

SUMMARY OF THE INVENTION

It is the object of the present invention to provide an automatic hook lock which can be utilized with either manually operated or motorized sliding gates and which is capable of being operated either manually or electrically. A second object of the present invention is to provide in a single mechanism economical means of achieving a remote control system of gate opening and shutting.

It is a further object of this invention to provide a lock which incorporates an automatic system of blocking the hook on the shutting of the gate, and the automatic freeing of the hook on the opening of the gate. It is a further object of this invention to provide a lock that contains an extremely low number of elements such as to obtain sure advantages from the operational, manufacturing and economical points of view.

BRIEF DESCRIPTION OF THE DRAWINGS

From the following detailed description, in conjunction with the accompanying drawings, the advantages of the said invention will be clearly seen. In the drawings.

DETAILED DESCRIPTION OF THE INVENTION

Figure 1:
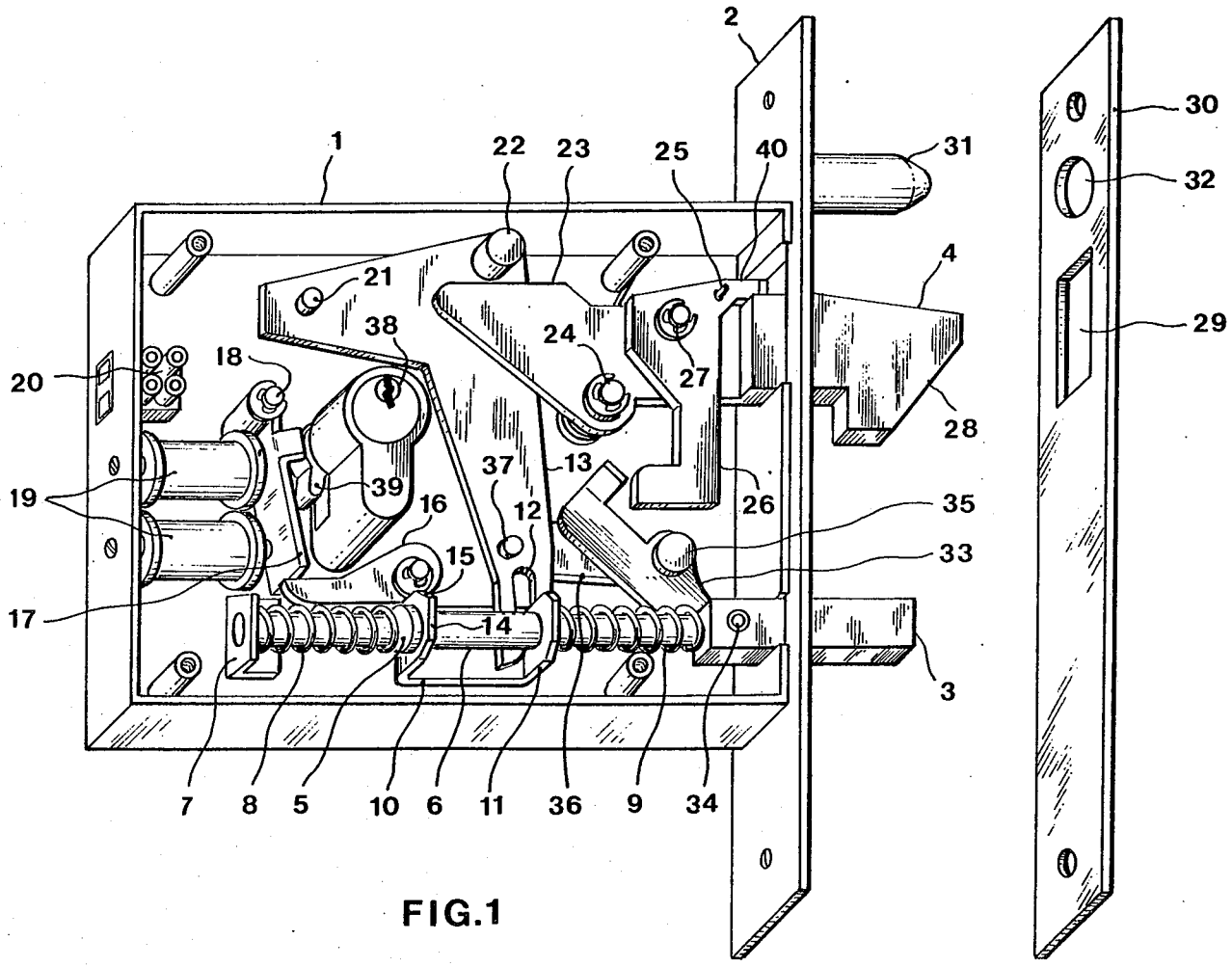
FIG. 1 depicts the basic components of the invention adapted for application on the surface or in the interior of a gate.

Referring to FIG. 1, in the box container 1, which is provided with a bearing flange 2 for attachment to a gate, there is provided a plunger 3, that has a horizontal movement, and a hook 4, that moves vertically guided by a slot on flange 2. Plunger 3 is unitarily formed with a ring lock 5 and with a rod 6 and moves freely across a support 7 and a U-bolt 10. Two spiral springs 8 and 9 encircle rod 6 and are positioned respectively between support 7 and ring lock 5 and between the plunger head 3 and U-bolt 10. Leg 11 of U-bolt 10 is free to engage a slit 12 on rocker lever 13, while the other leg 14 of U-bolt 10 engages a notch 15 on a lever 16 whose extreme end presses against the edge of a magnetic plate 17. Plate 17 is capable of rotating on pin 18 adjacent a solenoid 19. A two pole terminal 20 is provided to connect the solenoid to a voltage source for the remote control of the mechanism.

The rocker lever 13, whose fulcrum is pin 21, bears a plug 22, which acts on lever portion 23 of hook 4. Lever portion 23 and hook 4 are pivoted about a fulcrum at pin 24. The free end 25 of a torsion spring is held by lever 26, while the other extremity of the torsion spring is coiled around pin 24 between the under surface of lever 23 and the underlying surface of box container 1. The function of the torsion spring is to furnish the necessary force to keep the hook 4 in a lowered position. The inclined surface 28 of the hook 4 serves to lift and guide the hook into the slot 29 on the lock plate 30 which is fixed on the gate post, while the alignment pin 31 fixed on the flange 2 enters into hole 32 on lock plate 30 during the last phase of closing of the gate.

The automatic blocking device is composed of elements 33, 36 and 26. A rocker lever 33 has a first fulcrum 34, situated on plunger 3, and a second fulcrum 35 which includes an underlying crank that ends on pin 37 situated on rocker lever 13. The end of lever 33 is bent at right angles to permit its hooking on the lower extremity of lever 26, whose fulcrum 27 is fixed on the lever 23 and which has a clockwise rotation induced by the torsion spring 25 and limited by the fact that its extremity 40 presses against the surface of hook 4.

Figure 2:
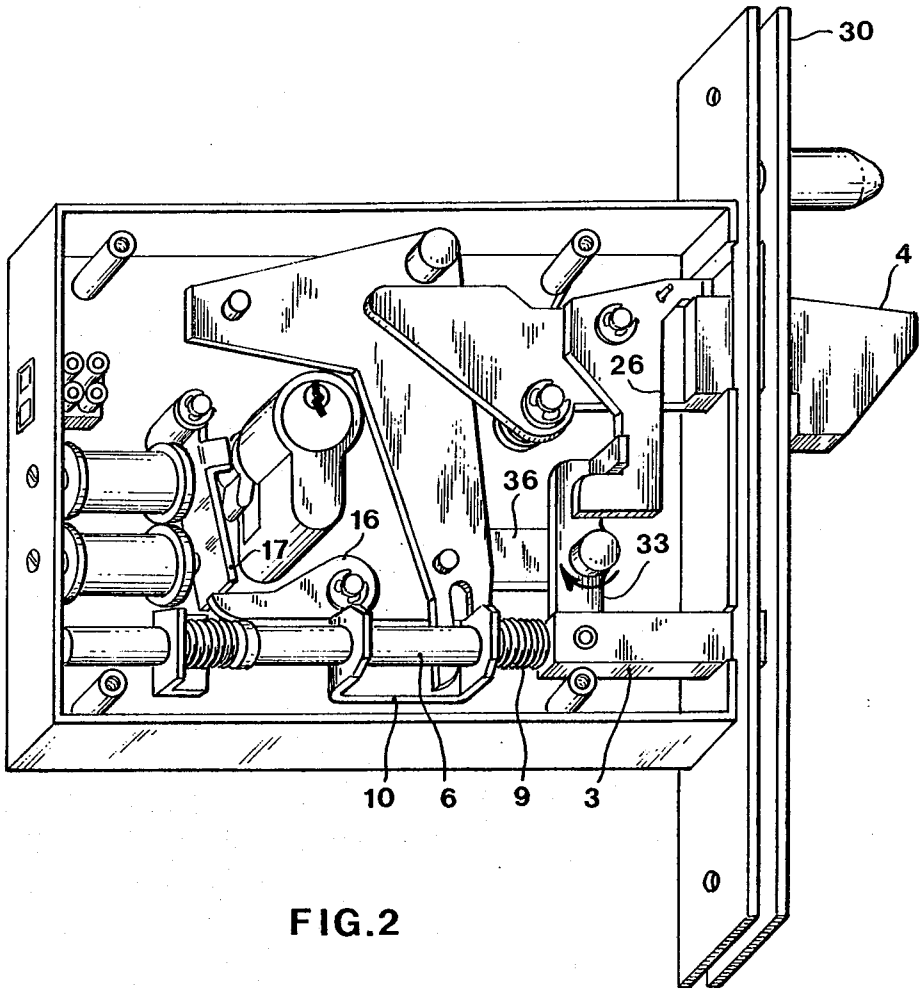
FIG. 2 depicts the locking mechanism in process of closing.

FIG. 2 indicates the functioning of the automatic hook lock in the process of closing. As the sliding gate closes, the hook 4 enters slot 29 in lock plate 30 which is fixed on the gate post. Hook 4 rises due to its inclined frontal plane 28, and in doing so raises the lever 26. After the first 10 mm. of movement of hook 4 in its slot, plunger 3 is automatically pushed inside the box container 1 and effects two contemporary actions, namely causing lever 33 to rotate clockwise and compressing coiled spring 9 against U-bolt 10.

The rotation of lever 33 is controlled by crank 36 which has the function of placing lever 33 in condition to couple itself with lever 26 at the precise moment that the hook 4, having surmounted with its inclined plane 28 the thickness of the lock plate, falls rapidly against the lower limit of the relative slot, taking the position indicated in FIG. 2, with the hook blocked by the final position of levers 26 and 33 and with plunger 3 completely inserted in box container 1. It is also evident that spring 9, completely compressed, causes U-bolt 10 to slide along rod 6 until its movement is arrested by lever 16 which in turn is blocked by plate 17.

Figure 3:
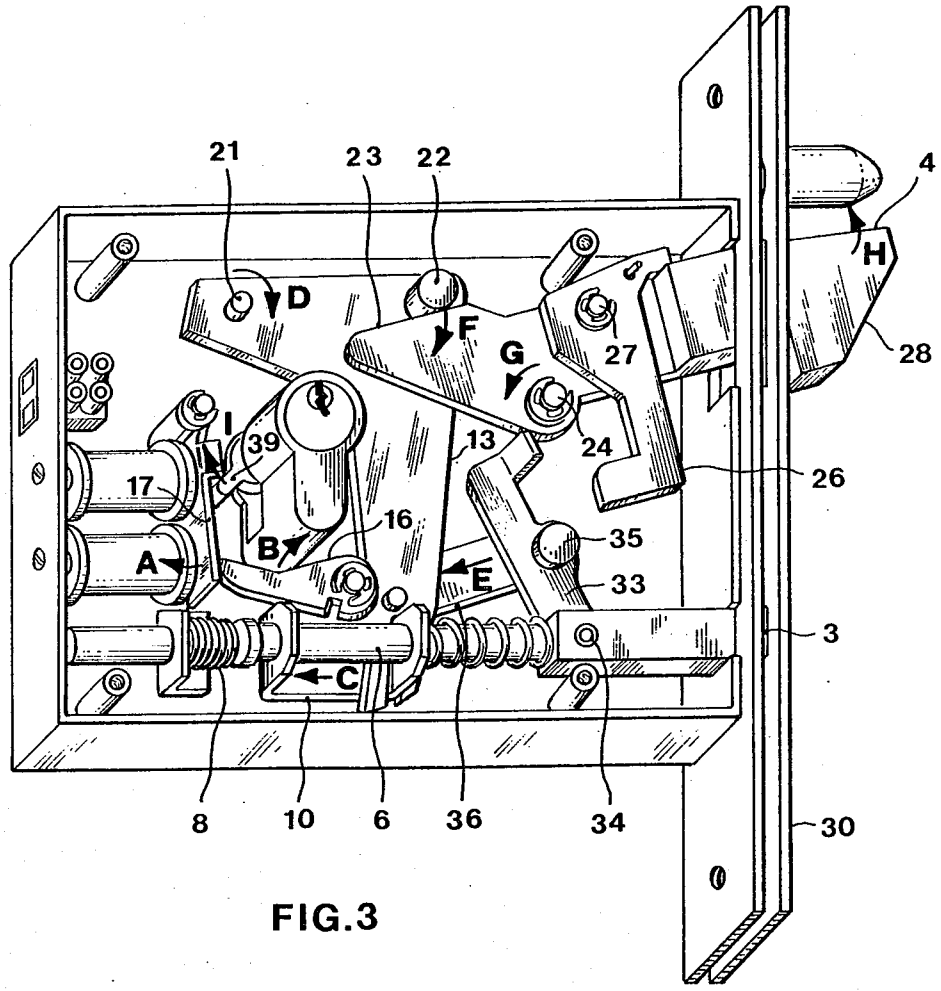
FIG. 3 depicts the locking mechanism in process of opening.

FIG. 3 indicates the mechanism in process of opening. The movement takes place in two syncronized operations: the releasing of the hook, and the raising of the same. The automatic releasing of the hook and its raising are initiated electrically, by means of solenoid 19, or mechanically by the use of a key inserted in a cylinder 38 to rotate the cylinder and also a pallet 39. The electrical opening of the lock occurs by means of an electrical impulse at low voltage applied to solenoid 19 which, attracting the magnetic plate 17, frees lever 16 which in turn, with its clockwise movement, frees U-bolt 10. The latter, under the pressure of the spring 9 and over-coming the force of the counter spring 8, rapidly moves along rod 6, causing lever 13 to rotate clockwise around pin 21. Pivoting of lever 13 moves crank 36 to cause the separation of levers 33 and 26. Further, pivoting of lever 13 causes plug 22 to force lever 23 downward, raising hook 4. In the FIG. 3, the several operations occur as indicated by arrows A–H in alphabetical order.

The manual opening of the lock is caused by the rotation of pallet 39 as an appropriate key (not shown in the figure) is turned in cylinder 38. Pallet 39 pushes magnetic plate 17 against solenoid 19 and gives rise to all the operations already described above.

I claim:

1. An electrically and manually operable lock mechanism for a sliding gate comprising:

a casing adapted for attachment to a sliding gate and including a bearing flange having an opening therethrough adapted to be aligned with a similar opening in a lock plate on a gate post as a gate having said lock mechanism attached thereto is closed against the gatepost;

a hook member pivotably mounted within said casing and extending through the bearing flange opening, with an inclined surface adapted to act upon an edge of the lock plate opening to pivotably raise said hook member as the sliding gate is closing against the gate post and to lower said hook member when the gate is fully closed, with said hook member then being hooked on the lock plate;

a first lever pivotably mounted within said casing and including a portion engaging said hook member to pivot said first lever in a first direction as said hook member is raised;

means for pivotably biasing said first lever in a second direction opposite the first direction to retain said first lever engaging portion in engagement with said hook member;

a rod member slidably mounted within said casing;

first moving means responsive to the closing of said lock mechanism against the lock plate as the sliding gate is closing against the gate post for moving said slidably mounted rod member to a first position;

latching means responsive to said slidably mounted rod assuming its first position for latching said first lever in a latched position with said engaging portion acting against said hook member to prevent raising of said hook member;

a blocking plate member movably mounted within said casing for movement between a first position and a second position;

means for biasing said blocking plate member to its first position;

electrical actuation means for moving said blocking plate member to its second position;

key operated manual actuation means for moving said blocking plate member to its second position;

second moving means responsive to movement of said blocking plate member to its second position for moving said latching means to release said first lever from the latched position and for pivotably raising said hook member to permit withdrawal of said hook member from the locking plate opening and sliding opening of the sliding gate; and third moving means responsive to movement of said lock mechanism away from the lock plate as the sliding gate is opening for moving said slidably mounted rod member to a second position and for releasing said hook member to permit said hook member to be freely raised and lowered.

2. A lock mechanism as claimed in claim 1 in which said first moving means comprises a plunger member extending from one end of said slidably mounted rod member through an opening in said bearing flange to contact the lock plate as the gate is closing.

3. A lock mechanism as claimed in claim 1 in which said second moving means comprises a U-bolt slidably mounted on said rod member; means for biasing said U-bolt to a first position on said rod member; means responsive to said blocking plate member being in its first position for retaining said U-bolt in a second position on said rod against the bias of said last-named biasing means; a second lever mounted within said casing for pivotal movement in response to movement of said U-bolt between the first and second U-bolt positions; coupling means coupling said second lever with said latching means for moving said latching means to a released position to release said first lever from the latched position; and means mounted on said second lever for acting on said hook member to pivotably raise said hook member.

4. A lock mechanism as claimed in claim 3 in which said third moving means comprises a spring mounted on said rod member for urging said rod member to its second position.

* * * * *